US005175976A

United States Patent [19]

Petry et al.

[11] Patent Number: 5,175,976

[45] Date of Patent: Jan. 5, 1993

[54] FEED STATION FOR FOLDING BOXES

[75] Inventors: Martin Petry, Giessen; Ralf Goersdorf, Biebertal, both of Fed. Rep. of Germany

[73] Assignee: Rovema Verpackungsmaschinen GmbH, Fernwald, Fed. Rep. of Germany

[21] Appl. No.: 706,810

[22] Filed: May 29, 1991

[30] Foreign Application Priority Data

Jun. 5, 1990 [DE] Fed. Rep. of Germany ... 9006297[U]

[51] Int. Cl.[5] ..... B65B 43/39

[52] U.S. Cl. ..... 53/252; 53/382.2; 53/387.2; 53/566

[58] Field of Search ..... 53/251, 252, 382.1, 53/382.2, 382.3, 387.2, 566

[56] References Cited

U.S. PATENT DOCUMENTS

| | | | |
|---|---|---|---|
| 2,441,372 | 5/1948 | Quigley et al. | 53/566 X |
| 2,631,767 | 3/1953 | Banks | 53/252 X |
| 3,224,165 | 12/1965 | Nigrelli et al. | 53/382.2 |
| 3,453,800 | 7/1969 | Mahncke | 53/252 X |
| 3,613,526 | 10/1971 | Jones | 53/566 X |
| 3,821,874 | 7/1974 | Jones | 53/252 X |
| 3,906,705 | 9/1975 | Beck et al. | 53/252 |
| 4,067,172 | 1/1978 | Paules | 53/566 X |

*Primary Examiner*—John Sipos
*Assistant Examiner*—Daniel B. Moon
*Attorney, Agent, or Firm*—Flynn, Thiel, Boutell & Tanis

[57] ABSTRACT

A feed station having a plate-retaining device which consists of a stationary guide arranged in front of or preceding the bridging belt for folding or swinging the side edge flaps of the folded box during an abutting thereof to a position wherein the plane thereof is parallel with respect to the direction of transport or movement. An additional guide plate oriented in a processing position subsequent to the stationary guide is provided, which guide plate is moved to hold the side edge flap of the folded box, which side edge flap is a trailing flap, open until the respective rear or trailing guide plate for the goods is oriented in front of the corresponding side edge flap.

7 Claims, 3 Drawing Sheets

FEED STATION FOR FOLDING BOXES

FIELD OF THE INVENTION

The invention relates to a feed station for folded boxes comprising a transport device which includes a first conveyor belt for the folded boxes, which boxes are open on at least one end, a second conveyor belt for carrying the goods to be inserted into the boxes, which second conveyor is arranged parallel to the first conveyor and is moved synchronously therewith, a bridging belt oriented between the first and second conveyor belts and extends parallel to the first and second conveyor belts and is driven synchronously therewith, which bridging belt has guide plates for laterally limiting the slide-in path of the goods into the folded boxes, and a reciprocal slide-in device for moving the goods into the folded boxes.

BACKGROUND OF THE INVENTION

In a feed station, in which the goods supplied by a separate conveyor belt are moved into folded boxes supplied by a second conveyor belt, it must be guaranteed, in order to achieve a smooth sequence of operation, that the goods when being moved into the boxes, do not run up against the side edge flaps of the box. It is known for this purpose to arrange a bridging belt between the conveyor belt for the folded boxes and the conveyor belt for the goods, which bridging belt has two lateral guide plates each facilitating a guiding and sliding of the goods into the box. The guide plates on the bridging belt must be aligned with respect to the folded boxes such that their side edge flaps each become oriented on the outer oppositely facing sides of the guide plates of the bridging belt. It must be assured here that at the moment when the guide plates are oriented in front of the opening into the folded box, the side edge flaps also lie on the respectively correct side of the guide plates.

It is known to arrange the guide plates for the side edge flap of the folded box, which side edge flap is oriented in front of and leads the guide plate on the bridging belt itself, while the guide plate for the trailing side edge flap of the folded box is arranged on a separate upper belt which runs synchronously above the bridging belt and the two other conveyor belts. The disadvantage of this solution is that a gap is formed automatically between the side plate of the upper belt and the bridging belt, thus there exists the danger that the goods can become jammed during the process of sliding into the box.

SUMMARY OF THE INVENTION

The basic purpose of the invention is to provide a feed station of the above-mentioned type such that same, on the one hand, is simpler in its design and thus less expensive and, on the other hand, the danger of jamming during a sliding of the goods into the folded box is avoided.

This purpose is attained according to the invention by the feed station having a plate-retaining means which consists of a stationary guide arranged in front of or preceding the bridging belt for folding or swinging the side edge flaps of the folded box during an abutting thereof to a position wherein the plane thereof is parallel with respect to the direction of transport or movement, and an additional guide plate oriented in a processing position subsequent to the stationary guide, which guide plate is moved to hold the side edge flap of the folded box, which side edge flap is a trailing flap, open until the respective rear or trailing guide plate for the goods is oriented in front of the corresponding side edge flap.

Thus, both upstanding partitioning guide plates for the goods to be moved into a folded box are, in the case of the feed station designed according to the invention, arranged on the bridging belt. Yet, in order to assure that the side edge flaps of the folded boxes lie each on the outer leading and trailing sides of the corresponding guide plates of the bridging belt, a stationary guide pressing the side edge flaps back is provided, which stationary guide cooperates with moving guide plates moved synchronously each with the rear or trailing side edge flap of a folded box so that the rear or trailing side edge flap swung by the stationary guide is held in this position by the moving guide plate until the upstanding partitioning guide plate on the bridging belt has assumed a position in which the side edge flap of the folded box lies on the outer or trailing side of the trailing partitioning guide plate. The moving guide plates are advantageously fastened on a wheel, arranged between the bridging belt and the conveyor belt for the folded boxes. The guide plates extend over a specific angle sector of the wheel. Two or more guide plates can thereby also be provided on the wheel.

The bridging belt is advantageously designed in two parts, namely, the front (leading) and the rear (trailing) partitioning guide plates are each arranged on a respective different one of the two parallel running parts of the bridging belt. This design has the advantage that the distance between the partitioning guide plates can be adjusted relatively to one another by moving the belts in a lengthwise direction relative to one another in order to adjust the format or spacing therebetween.

BRIEF DESCRIPTION OF THE DRAWINGS

One exemplary embodiment of the invention will be described in greater detail hereinafter in connection with the drawings, in which.

DETAILED DESCRIPTION

Figure 1:
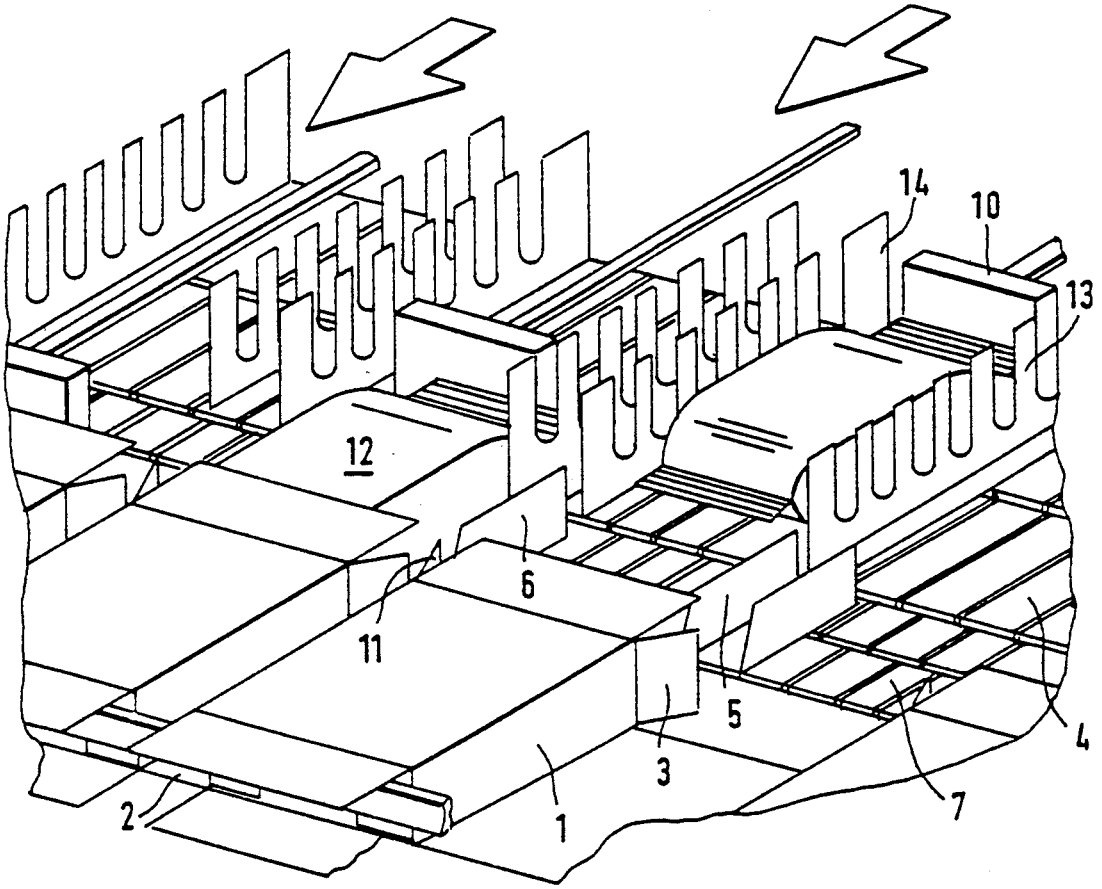
FIG. 1 is a perspective illustration of a feed station embodying the invention.
Figure 2:
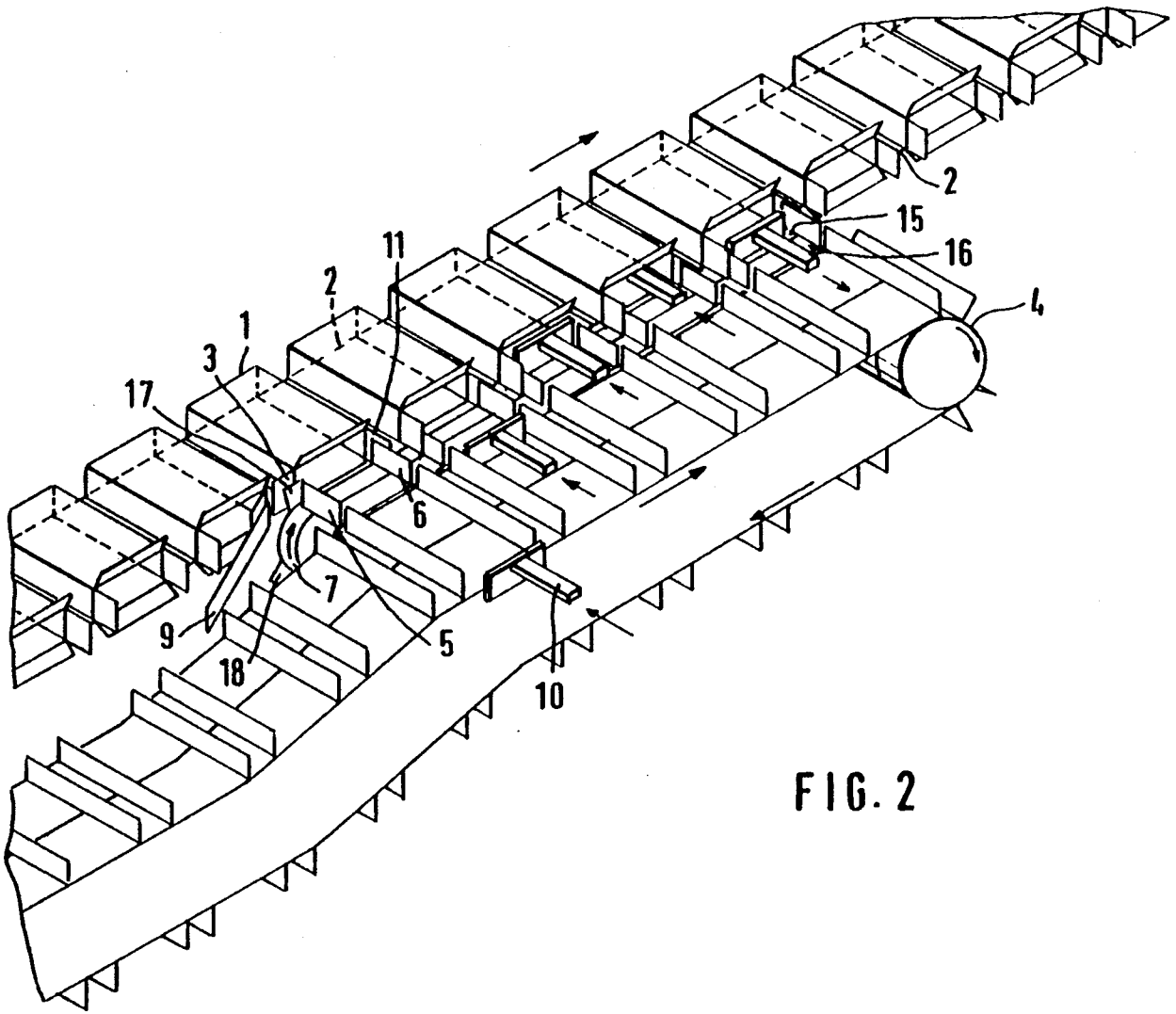
FIGS. 2 to 7 illustrate the feed station according to FIG. 1 in a time related sequence causing the guide plates on the bridging belt to become oriented in between the side edge flaps on the folded box.

As shown in a perspective view of a feed station according to the invention illustrated in FIG. 1, a conveyor belt 2 in the form of a driving chain is provided onto which a partially folded box 1 is placed. The partially folded box 1 can either be open at both ends or, however, it can be opened at only one end, as this is shown in FIG. 2. A further conveyor belt 4 is arranged parallel to the conveyor belt 2, which further conveyor belt is constructed as a partitioned belt and receives between upstanding partitioning walls 13,14 the goods 12 to be inserted into the open end of the box. The conveyor belt 2 and the conveyor belt 4 are moved synchronously with one another so that opposing each associated folded box 1 is the goods 12 which is to be inserted into the associated box. In the exemplary embodiment, the goods are prepackaged in a bag. A bridging belt 7 is arranged between the two conveyor belts 2,4, which belt 7 lies also parallel and is driven synchronously with the two conveyor belts 2,4. The bridging belt 7 is supported on guide rollers, one of the guide rollers 7A being shown in each of FIGS. 3-7. The bridging belt 7 has upstanding guide plates 5,6 thereon arranged and aligned in parallel with respect to the upstanding partitioning walls 13,14 on the conveyor belt 4.

The bridging belt 7 actually consists of two belts 15,16, which are driven synchronously, however, can be adjusted in the lengthwise direction relative to one another. The guide plate 5,6 are each arranged on separate belts 15,16 so that by a relative adjustment of the belts with respect to one another, the distance between the guide plates and thus the format can be adjusted. The conveyor belt 4 is designed accordingly so that the size of the slide-in area can be adjusted to the respective width of the goods. The prepackaged goods is moved into the open end of the box with the help of a reciprocal ram 10.

Since the guide plates 5,6 are spaced only a relatively short distance from the open end of the folded box 1, and since the side edge flaps 3,11 of the box grip behind the guide plates 5,6, attention must be paid during the feeding in of the guide plates 5,6 that the side edge flaps 3 and 11 of the folded box 1 rest in each case on the outer sides of the guide plates 5,6.

A stationarily arranged guide 9 is provided and is used to align the side edge flaps 3,11 of the folded box 1, which guide 9 is arranged inclined with respect to a forward direction of movement of the folded boxes to cause the side edge flaps 3,11, when engaged by the guide 9, to each be folded in a rearward direction relative to the direction of movement of the boxes. The guide 9 is of no significance for the front or leading side edge flap 11, because same will, immediately after passing the guide 9, be folded into its original position so that the front or leading guide plate 6 approaching it from the rearwardly facing side can take a position behind the side edge flap to cause it to become oriented on the outer side of the guide plate 6.

The guide 9, however, is not sufficient to guarantee that the trailing side edge flap 3 of the folded box 1 rests on the outer side of the rear or trailing guide plate 5. In order for the rear or trailing side edge flap 3 to be held open for a longer period of time, namely, until the rear or trailing guide plate 5 on the bridging belt has passed the open side edge flap 3, plural guide plates 17 are provided, which guide plates are each fastened to a driven wheel 18 arranged between the bridging belt 7 and the conveyor belt 2 and oriented so that an axis of the wheel 18 is coaxial with respect to an axis of the guide roller 7A. The guide plates on the wheel 18 each have a guide surface substantially aligned with the plane of the wheel, which guide surfaces 17 become positioned in front of the trailing side edge flap 3 of the folded box 1, which side edge flap has been previously urged by the guide 9 toward the rear, to hold the side edge flap 3 open for a longer time interval until the rear or trailing guide plate 5 on the bridging belt has passed the side edge flap 3. The peripheral speed of the wheel 18 is greater than the speed of the bridging belt 7. This guarantees that the side edge flaps 3, with certainty, become oriented on the outer or trailing side of the guide plate 5. After the two guide plates 5 and 6 each lie between the two side edge flaps 3 and 11, the goods 12 can be inserted into the open end of the box by means of the reciprocal ram 10.

Figure 3:
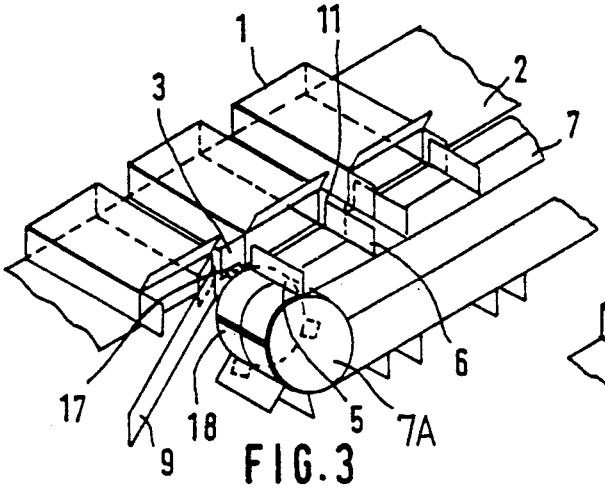
Figure 4:
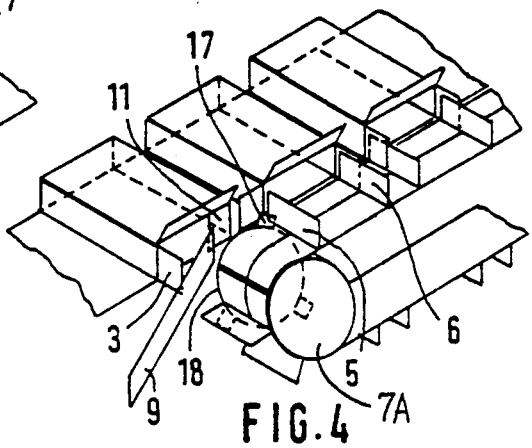
Figure 5:
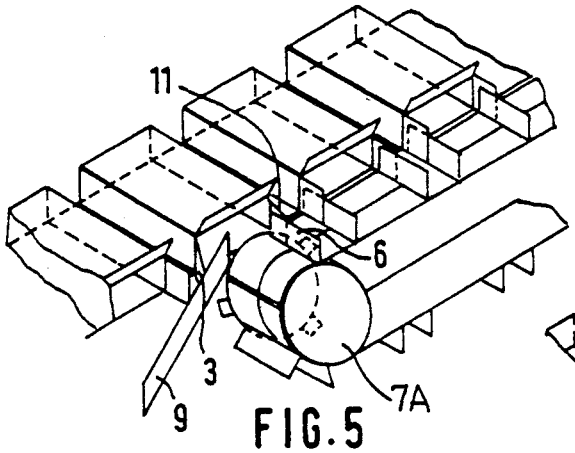

FIGS. 3 to 7 illustrate in individual method steps the sequential positioning of the guide plates 5,6 between the two side edge flaps 3,11 of the folded box. FIG. 3 shows how the front or leading side edge flap 11 is folded first rearwardly by the guide 9. FIG. 4 shows the folded side edge flap 11 shortly before it is again released by the guide 9. FIG. 5 shows how the front or leading guide plate 6 grips behind the side edge flap 11. The trailing side edge flap 3 then abuts the guide 9 and is moved rearwardly by the guide 9.

Figure 6:
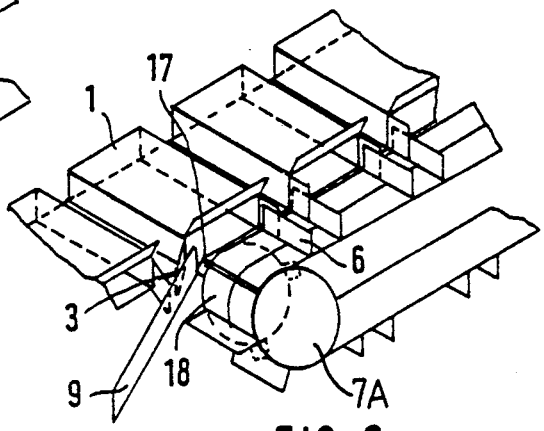
Figure 7:
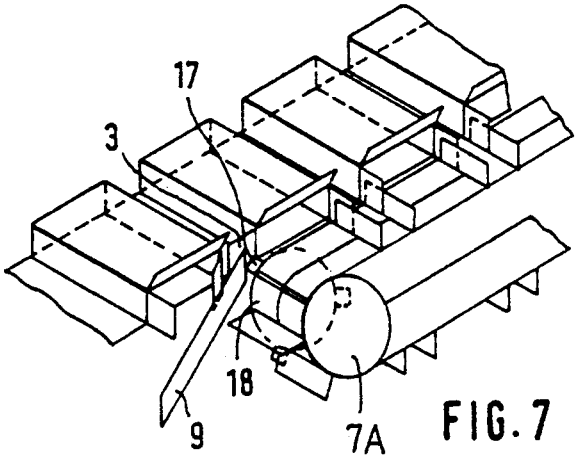

This process has further advanced in FIG. 6, namely, the front or leading guide plate 6 has here assumed its final position, that is, it is now aligned parallel to the leading wall of the opening into the folded box 1. The rear or trailing flap 3 is further opened. FIG. 7 shows how the rear or trailing side edge flap 3 still being held by the guide 9 is already being held by the guide plate 17. The side edge flap 3, as shown in FIG. 3, is thereby held back away from the opening into the box until the rear or trailing guide plate 5 of the bridging belt 7 has passed the trailing side edge flap 3. The rear or trailing side edge flap 3 is thereafter released, as this is shown in FIGS. 4 and 5, so that same becomes oriented against the outer trailing side of the guide plate 5.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a feed station for placing goods into folded boxes having first and second side edge flaps thereon comprising a transport device including a first conveyor belt for the folded boxes, which boxes are each open on at least one end, the first side edge flap, as the box moves in a selected direction of movement, leading the second side edge flap, a second conveyor belt for supplying the goods to be placed into the boxes. which second conveyor belt is arranged parallel to the first conveyor belt and is moved synchronously therewith, a bridging belt oriented between the first and second conveyor belts and extending parallel thereto and driven synchronously therewith, which bridging belt has upstanding leading and trailing partitioning guide plates for laterally limiting a slide-in path of the goods into the folded boxes, and a slide-in device for moving the goods into the folded boxes, the improvement wherein the feed station has a flap-retaining means comprising a guide stationarily arranged in front of and upstream of the bridging belt for swinging the first and second side edge flaps of the folded box, during abutment therewith, to a position oriented parallel with respect to the direction of movement of the boxes and wherein said flap retaining means further includes a moving guide plate oriented in a processing position downstream to the stationary guide, which moving guide plate holds the second side edge flap of the folded box, which second side edge flap is a trailing flap, away from the box opening until the respective trailing partitioning guide plate for the goods lies in front of the corresponding second side edge flap.

2. The feed station according to claim 1, wherein the moving guide plate is fastened adjacent the periphery of a wheel and a surface thereon extends substantially parallel with respect to a plane of the wheel, the wheel being arranged between the conveyor belt for the folded boxes and the bridging belt.

3. The feed station according to claim 2, wherein several moving guide plates are arranged on the wheel.

4. The feed station according to claim 2, wherein an axis of the wheel is arranged coaxially with respect to guide rollers for the bridging belt.

5. The feed station according to claim 2, wherein the peripheral speed of the wheel is greater than the speed of the bridging belt.

6. The feed station according to claim 1, wherein the bridging belt consists of two parallel extending belts, of which one has the leading guide plate thereon and the other one has the trailing guide plate thereon for the goods.

7. The feed station according to claim 6, wherein the two parallel belts forming the bridging belt can be adjusted with respect to one another in order to adjust the spacing between the upstanding guide plates.

* * * * *